US006903627B2

(12) United States Patent
Wakamatsu et al.

(10) Patent No.: US 6,903,627 B2
(45) Date of Patent: Jun. 7, 2005

(54) DIELECTRIC RESONATOR, FILTER, DUPLEXER AND COMMUNICATION DEVICE

(75) Inventors: Hiroki Wakamatsu, Ishikawa-ken (JP); Hiroyuki Kubo, Kusatsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 190 days.

(21) Appl. No.: 10/252,721

(22) Filed: Sep. 24, 2002

(65) Prior Publication Data

US 2003/0058067 A1 Mar. 27, 2003

(30) Foreign Application Priority Data

Sep. 27, 2001 (JP) ..... 2001-297959

(51) Int. Cl.[7] ..... H01P 5/12
(52) U.S. Cl. ..... 333/134; 333/202; 333/219.1
(58) Field of Search ..... 333/134, 227, 333/219.1, 202, 206

(56) References Cited

U.S. PATENT DOCUMENTS

| | | | | |
|---|---|---|---|---|
| 5,075,407 A | * | 12/1991 | Cody et al. | 528/71 |
| 5,403,655 A | * | 4/1995 | Deviney et al. | 428/319.7 |
| 5,874,870 A | * | 2/1999 | Nishiyama et al. | 333/202 |
| 5,898,349 A | * | 4/1999 | Hattori et al. | 333/202 |
| 6,472,955 B2 | * | 10/2002 | Saito et al. | 333/134 |
| 6,605,347 B2 | * | 8/2003 | Amano et al. | 428/355 RA |
| 6,614,327 B2 | * | 9/2003 | Saito et al. | 333/202 |

FOREIGN PATENT DOCUMENTS

| | | |
|---|---|---|
| DE | 195 24 633 A1 | 1/1997 |
| JP | 10-290102 | 10/1998 |
| JP | 2001-177313 | 6/2001 |

OTHER PUBLICATIONS

Copy of European Combined Search and Examination Report dated Jun. 5, 2003.
Copy of German Office Action dated Mar. 24, 2004 (and English translation of same).

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

The present invention provides a dielectric resonator having increased reliability with respect to thermal cycle fatigue of a joint between a conductive cavity and a dielectric core disposed in the cavity without an increase in material cost and processing cost, a filter and duplexer each using the dielectric resonator, and a communication device including these devices. The dielectric resonator has a structure in which the dielectric core is provided in the cavity through earth plates. Each of the earth plates has slits provided at positions in contact with the four corners of each of two opposing side faces of the dielectric core. Of the four sides of each of the earth plates, the two sides provided with spring portions are preferably inclined so that the distance between the two sides decreases toward the bottom of the cavity, and concave portions are formed in the inner surface of the cavity corresponding to the two inclined sides. Therefore, solder cream can be previously applied to predetermined positions of the concave portions of the cavity.

10 Claims, 8 Drawing Sheets

DIELECTRIC RESONATOR, FILTER, DUPLEXER AND COMMUNICATION DEVICE

BACKGROUND OF THE INVENTION

1. Field of the Invention

The present invention relates to a dielectric resonator having a dielectric core and a cavity, a filter and a duplexer each using the dielectric resonator, and a communication device comprising these devices.

2. Description of the Related Art

A dielectric resonator comprising a dielectric core disposed in a cavity is conventionally used as a small resonator using relatively high electric power in a microwave band.

For example, a dielectric resonator using a TM mode comprises a dielectric core which is made of dielectric ceramic and which is disposed in a ceramic or metal cavity having an electrode film provided on its surface.

FIGS. 10, 11A and 11B show an example of the construction of a conventional dielectric resonator. FIG. 10 is an exploded perspective view, and FIGS. 11A and 11B are a top view and a sectional view, respectively. In this example, a dielectric core 3 having electrodes formed on each of two opposing side faces is inserted into a metal cavity body 1, and both side faces are soldered to the inner surface of the cavity body 1 with solder 6. Also, a cavity cover 2 is provided on an opening of the cavity body 1.

In this structure in which both side faces of the columnar dielectric core are joined to the inner wall of the cavity, when the dielectric core and the cavity have a large difference between coefficients of linear expansion, the joints between the dielectric core and the cavity deteriorate due to heat cycle fatigue, causing a problem in which sufficient reliability cannot easily be obtained.

Therefore, another structure is used in which a dielectric core and a cavity are integrally molded. In this structure, the dielectric core and the cavity are made of the same ceramic material, and thus the problem of heat cycle fatigue does not occur.

However, in the structure in which the dielectric core and the cavity are integrally molded, most of the cavity, which need not have dielectricity, is formed by using a dielectric ceramic material, and thus the material cost is increased. Furthermore, the mold used becomes complicated and increases the production cost.

The applicant filed Japanese Application No. 11-283037 relating to a resonator device comprising a conductive bar and a dielectric core, both of which are provided in a cavity, so as to use both a resonance mode and a coaxial (semi-coaxial) resonance mode due to the dielectric core. However, the cavity made of a general metal material such as aluminum and the dielectric core have a large difference between the coefficients of linear expansion, and thus sufficient reliability cannot be achieved for the joints between the dielectric core and the inner wall of the cavity. If a metal material having substantially the same coefficient of linear expansion as the dielectric ceramic material of the dielectric core is used for forming the cavity, the above problem can be resolved, but there is the problem of increasing the material cost of the cavity and the production cost required for processing the cavity.

SUMMARY OF THE INVENTION

Accordingly, it is an object of the present invention to provide a dielectric resonator having increased reliability with respect to heat cycle fatigue of joints between a conductive cavity and a dielectric core disposed in the cavity without increasing material cost and processing cost, a filter and a duplexer each using the dielectric resonator, and a communication device comprising these devices.

A dielectric resonator of the present invention comprises a dielectric core having an electrode formed on each of two opposing side faces, a conductive cavity, and earth plates each comprising a joint and a bent spring portion, the joints being jointed to the respective side faces of the dielectric core with a conductive binder, and the spring portions being joined to the inner surface of the cavity with a conductive binder, wherein each of the earth plates has slits provided at positions in contact with the four corners of each of the two side faces of the dielectric core.

In this structure, thermal stress due to a difference between linear expansion coefficients produced in the joint surfaces between the two side faces of the dielectric core and the earth plates is prevented from concentrating in the four corners of each of the two side faces of the dielectric core.

In the dielectric resonator of the present invention, the materials of both the earth plates and the dielectric core are preferably selected so that the difference between the coefficients of linear expansion is within ±2 ppm/° C. This can decrease the thermal stress produced in the joint surfaces.

In the dielectric resonator of the present invention, each of the earth plates preferably has protrusions formed to engage with the edges of each end of the dielectric core. In this structure, the dielectric core can be easily positioned relative to the earth plates to increase the positioning precision of the dielectric core in the cavity.

In the dielectric resonator of the present invention, the cavity preferably has a bottom, an opening parallel to the bottom, and at least two parallel sides vertical to the bottom, and each of the earth plates preferably has a substantially rectangular shape having sides parallel to the bottom and the opening of the cavity. Each of the earth plates also preferably has a bent-up portion provided on the side parallel to the opening of the cavity, so that solder cream can be applied to the portion between the side of the cavity and the earth plates.

In this structure, with the earth plates joined to the dielectric core, solder cream can be applied to the side of each of the earth plates parallel to the opening of the cavity in which the dielectric core is disposed.

In the dielectric resonator of the present invention, each of the earth plates preferably has a trapezoidal shape having two sides parallel to the bottom and the opening of the cavity, and other two sides inclined so that the distance between the two sides decreases from the opening of the cavity in the depth direction, and a concave portion is formed in the side of the cavity so that the bottom side and the two inclined sides of each of the earth plates are butted on the concave portion.

In this structure, in soldering the three sides of each of the trapezoidal earth plates to the side of the cavity, solder cream can be previously applied to the concave portion of the side of the cavity.

In the dielectric resonator of the present invention, the space between each of the earth plates and the side of the cavity is preferably filled with a thermosetting resin, and the resin is cured to fix the earth plates to the cavity by bonding.

The elastic modulus of the thermosetting resin is preferably set to the order of $10^7$ Pa to $10^9$ Pa in the working temperature range of the dielectric resonance.

A filter of the present invention comprises the dielectric resonator having the above structure, and signal input/output means combined with the resonance-mode electromagnetic field of the dielectric resonator for inputting and outputting a signal.

A duplexer of the present invention comprises, for example, two dielectric resonators or filters having the above structure, and bonding means provided as a common antenna input/output terminal for connecting the two dielectric resonators.

Furthermore, a communication device of the present invention comprises the filter or the duplexer of the present invention.

DESCRIPTION OF THE PREFERRED EMBODIMENTS

The construction of a dielectric resonator according to a first embodiment is described with reference to FIGS. 1 to 6.

Figure 1:
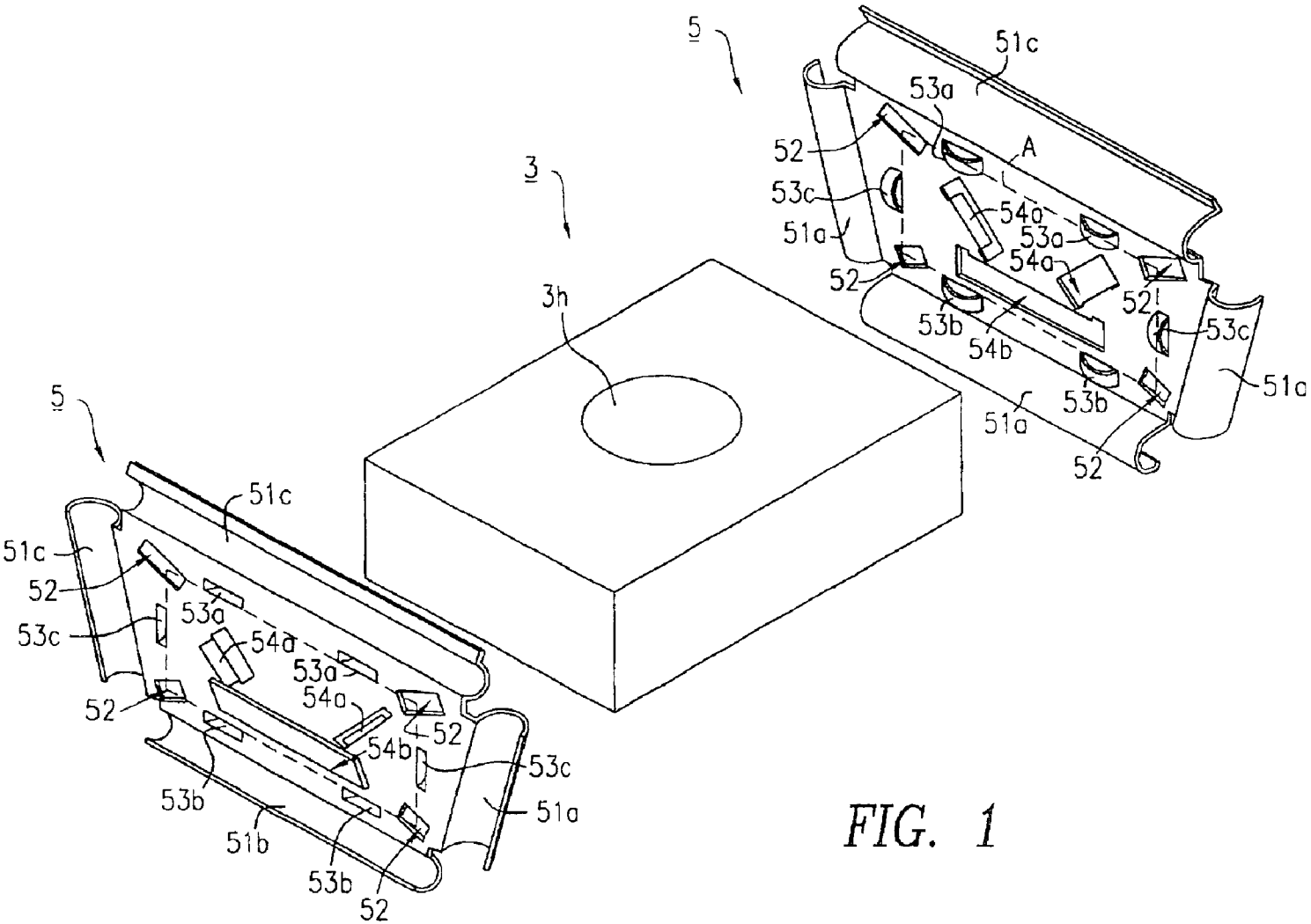
FIG. 1 is a perspective view showing the components of a dielectric resonator according to an embodiment of the present invention.

FIG. 1 is a perspective view showing the components of a dielectric resonator. In FIG. 1, reference numeral 3 denotes a dielectric core having a substantially rectangular outer shape and a circular hole 3*h* being provided at the center. Also, an Ag electrode film is formed on each of two opposing side faces of the dielectric core 3 by burning.

In FIG. 1, reference numeral 5 denotes a Cu foil or an earth plate plated with an Ag film. As described below, the earth plates 5 are respectively joined to the two side faces of the dielectric core 3, and inserted into a cavity.

Figure 2:
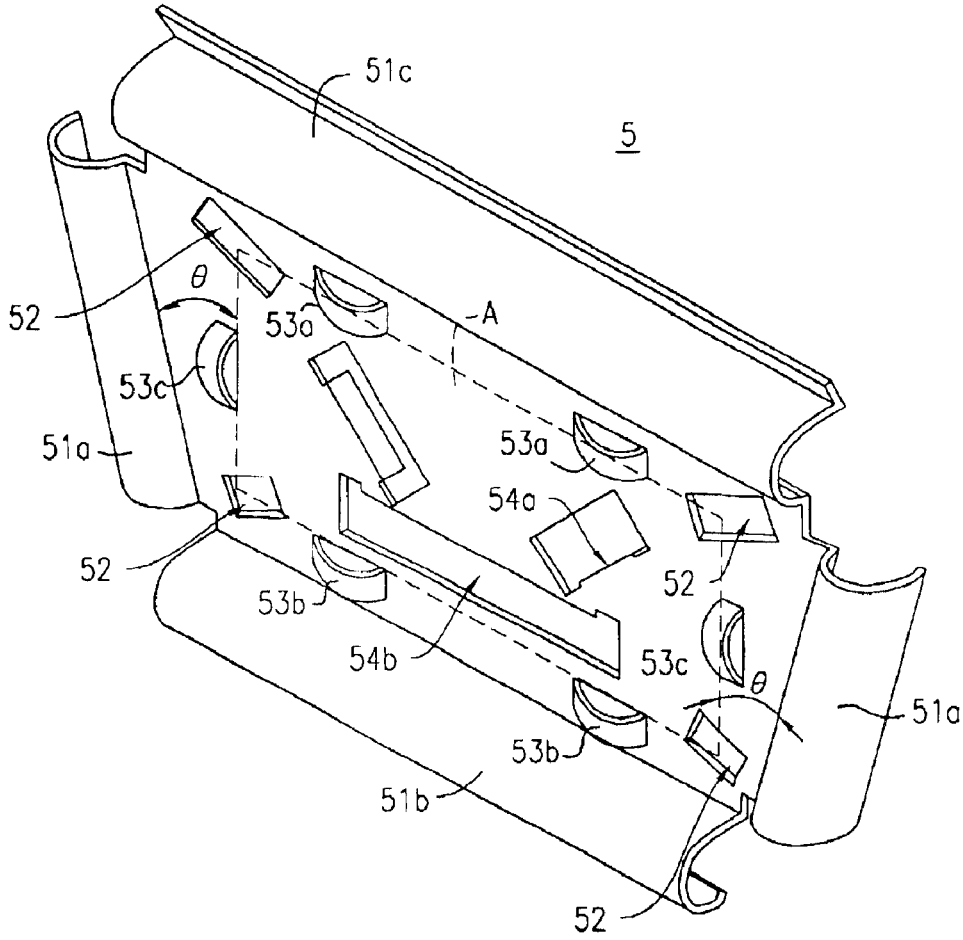
FIG. 2 is a perspective view showing the construction of an earth plate.

FIG. 2 is a perspective view showing the construction of the earth plate 5. The earth plate 5 is preferably formed by processing a sheet metal. In FIG. 2, reference numerals 51*a*, 51*b* and 51*c* each denote a spring portion which is bent for maintaining elasticity when being joined to the side of the cavity.

In FIG. 2, the region surrounded by broken line A denotes a region in contact with each of the two side faces of the dielectric core 3. Also, four slits 52 are provided at the positions in contact with the four corners of each of the two side faces of the dielectric core 3. When a temperature change occurs after the two side faces of the dielectric core 3 are respectively joined to the predetermined regions of the earth plates 5, strain stress occurs in the joint surfaces between the two side faces of the dielectric core 3 and the earth plates 5 due to a difference between the linear expansion coefficients of the dielectric core 3 and the earth plates 5. For example, when a general ceramic dielectric core having a linear expansion coefficient of 6 to 9 ppm/° C. is combined with an earth plate comprising a phosphor-bronze plate, the difference between the linear expansion coefficients of both materials is over ten ppm/° C.

The stress due to the difference between the linear expansion coefficients is generally concentrated in the corners of each side face of a dielectric core. However, as shown in FIG. 2, the slits 52 are respectively provided at the positions in contact with the four corners of each of the two side faces of the dielectric core, and thus concentration of the stress can be decreased to prevent peeling of the earth plates 5 from the two side faces of the dielectric core.

The slits 52 are preferably formed in a shape in which the sides in the radial direction from the center (the center of region A) of each of the two side faces of the dielectric core are long, and the sides in the circumferential direction are short (e.g., rectangular in shape). This shape does not intercept an effective current flowing in each of the earth plates 5, thereby causing no adverse effect on electrical characteristics.

Each of the earth plates 5 has protrusions 53*a*, 53*b* and 53*c* which are provided to engage with the edges of each end of the dielectric core 3. Namely, a plurality of protrusions 53*a*, 53*b* and 53*c* are disposed along the outer edge of the region A in contact with each of the two side faces of the dielectric core 3. These protrusions facilitate positioning of the earth plates 5 at the mounting positions relative to the two side faces of the dielectric core 3, and function as positioning members. Therefore, precision of the relative position between the dielectric core 3 and the earth plates 5 can be improved.

Each of the earth plates 5 also has cut-up portions 54*a* and 54*b*, as shown in FIG. 2. The cut-up portions 54*a* and 54*b* function as a gate for a thermosetting resin injected into the space between the inner surface of the side of the cavity and the earth plates 5, as described below.

Figure 3:
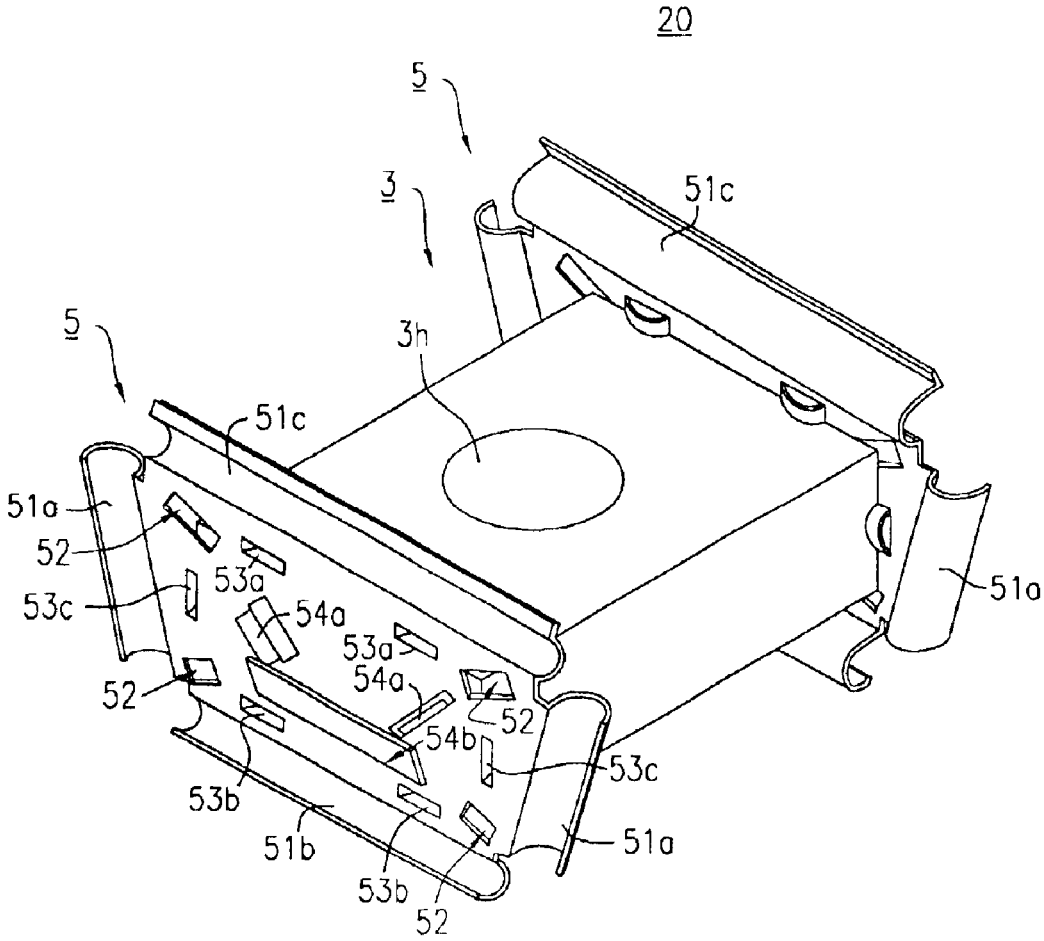
FIG. 3 is a perspective view showing the construction of a dielectric core unit.

FIG. 3 shows a state in which the earth plates 5 are mounted on both ends of the dielectric core 3 shown in FIG. 1. The joint surfaces between each side face of the dielectric core 3 and the earth plate 5 are joined together with solder. However, solder cream may be simply applied to the two side faces of the dielectric core 3 before the dielectric core 3 is inserted into the cavity without soldering, and then the dielectric core 3 may be inserted into the cavity body with the two earth plates 5 respectively butted on the two side faces of the dielectric core 3. Namely, the earth plates 5 may be soldered to the dielectric core 3 at the same time the earth plates 5 are joined to the side of the cavity body 1.

In this embodiment, each of the earth plates 5 has the four slits 52 provided at positions in contact with the four corners of each of the two side faces of the dielectric core 3. However, without the slits 52, the materials of the earth plates 5 and the dielectric core 3 may be determined so that the difference between the linear expansion coefficients of the earth plates 5 and the dielectric core 3 is within ±2 ppm/° C. For example, when a ceramic dielectric core having a linear expansion coefficient of 6 ppm/° C. is used as the dielectric core 3, and "42 Ni alloy" is used for the earth plates 5, the difference between the linear expansion coefficients of both materials is 1.3 ppm/° C., and thus lies in the range of ±2 ppm/° C.

Figure 4:
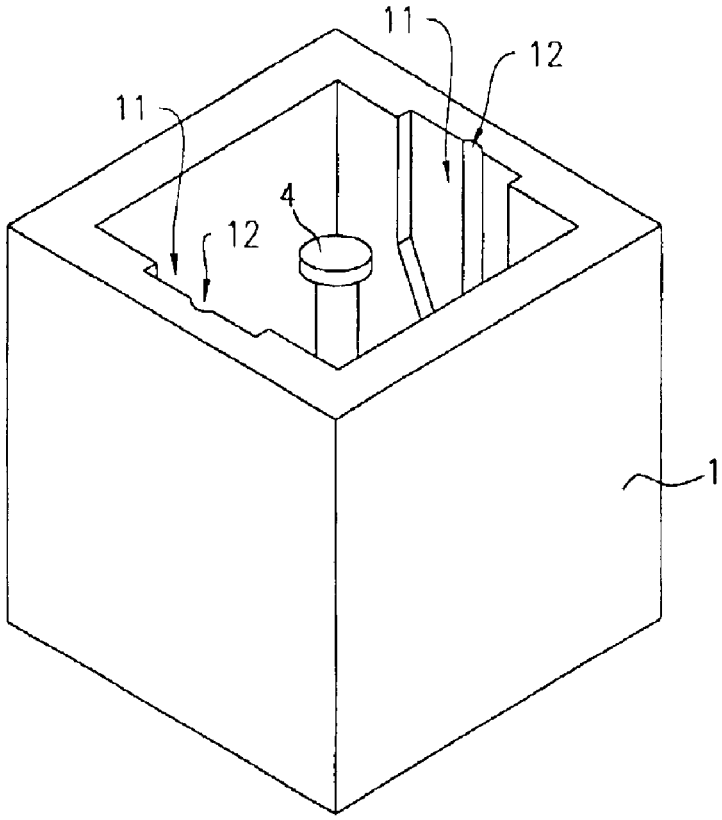
FIG. 4 is a perspective view showing the construction of a cavity body.

FIG. 4 is a perspective view showing the construction of the cavity body 1. The cavity body 1 a rectangular box-like shape having a bottom and made of an Ag-plated metal such as aluminum or Invar. Also, a cylindrical conductive bar 4 is provided to extend from the bottom to the opening of the cavity body 1. Furthermore, a cavity cover made of an Ag-plated metal such as aluminum or Invar is provided on the upper opening shown in the drawing.

In the cavity body 1, concave portions 11 are formed in the inner surfaces of the two opposite sides of the cavity body 1, for respectively guiding the earth plates 5 into the cavity body 1 and mounting the earth plates 5 at predetermined positions in the cavity body 1. Furthermore, a thermosetting resin injection groove 12 is formed at the center of each of the concave portions 11 to extend in the depth direction of the cavity body 1.

Figure 5:
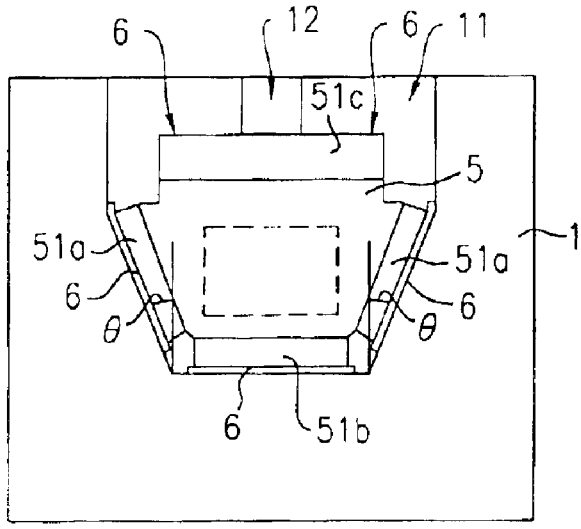
FIG. 5 is a drawing showing a state in which earth plates are provided in the cavity body.

FIG. 5 is a drawing showing the inside of the cavity body 1 having the concave portions 11 formed in the sides thereof. Each of the concave portions 11 is formed to have surfaces which are butted on the bottom side of the corresponding earth plate 5 in parallel to the bottom of the cavity body 1, and the two sides inclined so that the distance between the two sides decreases toward the bottom of the cavity body 1. The inclination angle θ of the inclined sides is preferably about 10° to 20°.

In each of the concave portions 11, the surfaces butted on the two inclined sides of each of the trapezoidal earth plates 5 are inclined, and thus even when solder cream 6 is previously applied to the surfaces, the solder cream 6 is not scraped off by the earth plates 5 during insertion of the earth plates 5 into the cavity body 1. Therefore, the solder cream 6 is previously applied to the surfaces of each of the concave portions 11, which are butted on the three sides of each of the earth plates 5, and the earth plates 5 are inserted into the cavity body 1 together with the dielectric core 3 so that the solder cream 6 is held between the three sides of each of the earth plates 5 and the inner surface of the cavity body 1. Then, solder cream 6 is applied, by a disperser, to the portion between the side of the cavity body 1 and the spring portion 51*c* provided on the side of each of the earth plates 5 in parallel to the opening of the cavity body 1.

In this state, the solder cream 6 is melted to solder the earth plates 5 to the cavity body 1 by a reflow soldering method. Melting the solder cream 6 produces fillets.

Figure 6:
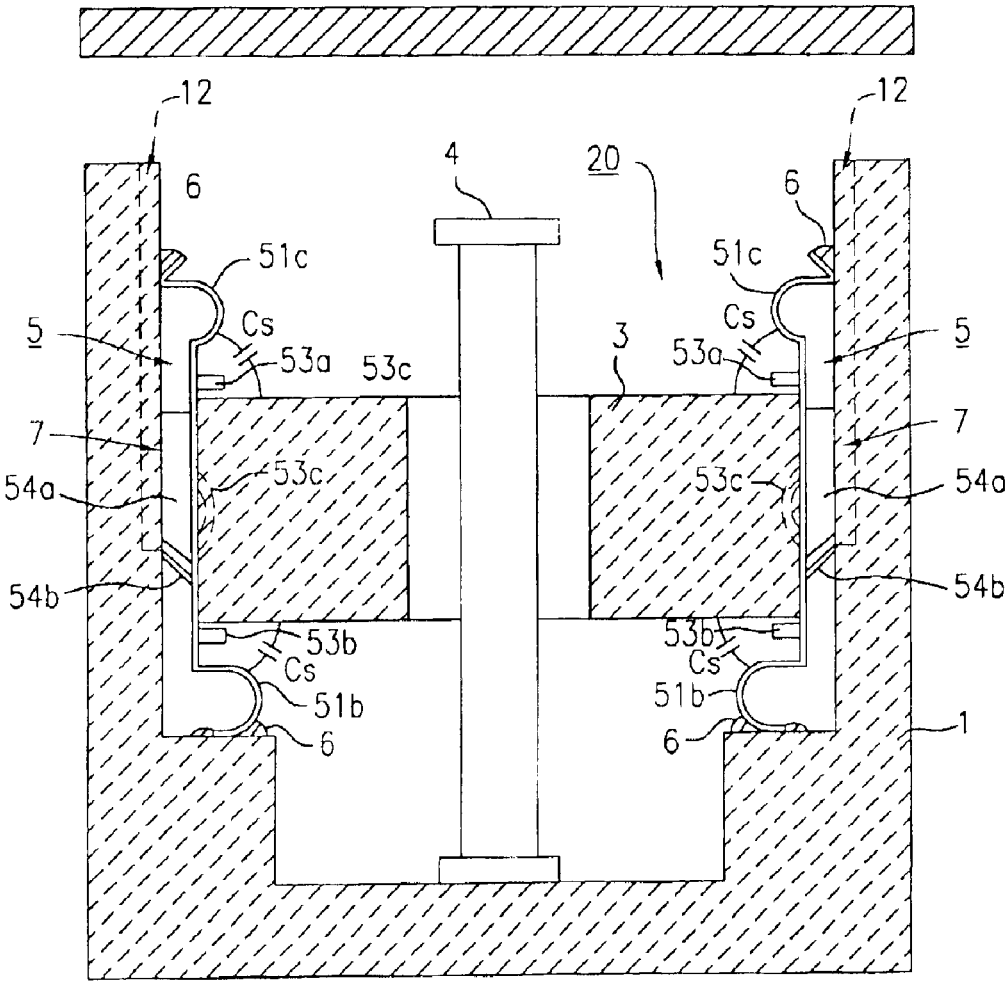
FIG. 6 is a sectional view showing a state in which a dielectric core unit is provided in a cavity.

FIG. 6 is a sectional view showing a state in which a dielectric core unit 20 is mounted in a cavity. As shown in FIG. 6, the spring portions 51 of the earth plates 5 are soldered to the inner surface of the cavity body 1, and then the thernosetting resin is injected from the grooves 12 shown in FIG. 5. At this time, the cut-up portions 54*a* and 54*b* function as the gates, and the spaces surrounded by the cut-up portions 54*a* and 54*b* is filled with the thermosetting resin 7. Then, the thermosetting resin 7 is cured by heating to fix the earth plates 5 to the cavity body 1 by bonding. Since the thermosetting resin 7 is also applied to the two side faces of the dielectric core 3 through the openings of the cut-up portions 54*a* and 54*b*, strength of bonding between the earth plates 5 and the dielectric core 3 can be increased.

As the thermosetting resin 7, an adhesive mainly composed of an epoxy or silicone resin, or a conductive adhesive comprising Ag or the like mixed with the epoxy or silicone resin can be used. Particularly, by using an epoxy adhesive containing rubber, an appropriate elastic modulus and high reliability of impact resistance can be obtained.

The elastic modulus of the thermosetting resin is preferably on the order of $10^7$ Pa to $10^9$ Pa in the working temperature range of the dielectric resonator. Namely, with the thermosetting resin having an elastic modulus of less than $10^7$ Pa, the resin is excessively soft, and thus has the weak function to fix the dielectric resonator, thereby easily causing a variation in the position of the dielectric resonator due to vibration and a deviation of the resonance frequency of the dielectric resonator. Conversely, with the thermosetting resin having an elastic modulus of over $10^9$ Pa, the resin is excessively hard, and thus strong stress is easily exerted on the dielectric resonator, thereby damaging the ceramic of the dielectric resonator having a failure stress of the 100 MPa order, and thus causing a defect in the dielectric resonator.

For example, when an epoxy resin having an elastic modulus of about 300 MPa at a temperature of 25° C. is used as the thermosetting resin 7, the elastic modulus of the thermosetting resin is 150 MPa to 3 GPa in the working temperature range of the dielectric resonator of −40° C. to +70° C. Therefore, high reliability and stable characteristics can be obtained in the working temperature range of the dielectric resonator.

By using the conductive adhesive as the thermosetting resin, the heat release effect and heat resistance can be improved due to the high thermal conductivity of the conductive adhesive.

Furthermore, the spring portions 51*a* and 51*b* of the earth plates 5 are not adjacent to the ends of the dielectric core 3 but are provided at a predetermined distance from the ends of the dielectric core 3. Therefore, the stray capacitance Cs produced between the ends of the dielectric core 3 and the spring portions 51 of each of the earth plates 5 can be suppressed. Therefore, the adverse effect of the earth plates 5 on electrical characteristics can be suppressed. Furthermore, even if the dielectric core 3 vibrates due to an external force, the capacitance Cs varies less. Therefore, variations in characteristics due to vibration can also be suppressed.

An example of the construction of a filter will be described below with reference to FIG. 7.

Figure 7:
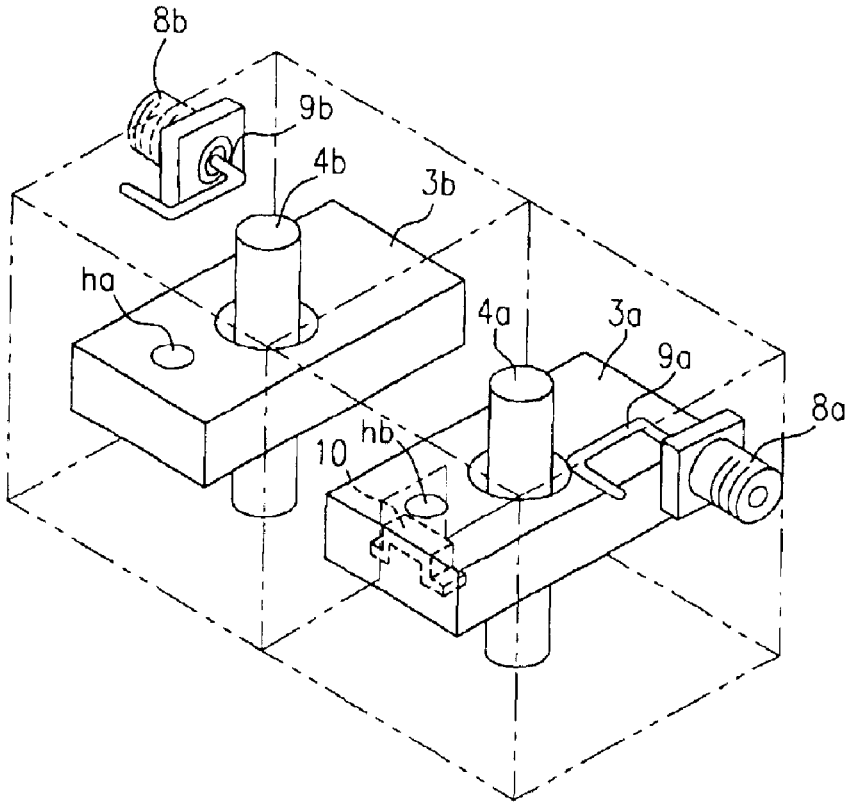
FIG. 7 is a drawing showing an example of the construction of a filter according to the present invention.

In FIG. 7, a cavity is shown by two-dot chain lines. In FIG. 7, earth plates are not shown, but each of dielectric cores 3*a* and 3*b* is mounted in the cavity as described above. The head of each of conductive bars 4*a* and 4*b* is spaced from the inner wall of the cavity. In this structure, the conductive bar 4*a* and the surrounding cavity function as a quasi-TEM mode resonator, and the dielectric core 3*a* and the surrounding cavity function as a quasi-TM mode resonator. Similarly, the conductive bar 4*b* and the surrounding cavity function as a quasi-TEM mode resonator, and the dielectric core 3*b* and the surrounding cavity function as a quasi-TM mode resonator. Reference numerals 8*a* and 8*b* each denote a coaxial connector, and the central conductors of these coaxial connectors 8*a* and 8*b* are connected to the inner surfaces of the cavities through coupling loops 9*a* and 9*b*, respectively. The coupling loops 9*a* and 9*b* are disposed so that a quasi-TM mode magnetic field is linked to the loop surfaces, and a quasi-TEM mode magnetic field is less linked to the loop surfaces. Therefore, the coupling loops 9*a* and 9*b* produce magnetic field coupling with the quasi-TM mode.

In FIG. 7, reference characters ha and hb each denote a coupling control hole for coupling the quasi-TM mode and the quasi-TEM mode. Furthermore, a window is formed in the wall surfaces of the adjacent two cavities, and a coupling loop 10 is provided across the window. The loop surface of the coupling loop 10 is disposed in the direction in which a quasi-TM mode magnetic field is not linked to the loop surface, and a quasi-TEM mode magnetic field is linked to the loop surface, thereby causing magnetic field coupling with the quasi-TEM mode produced in each of the cavities. Therefore, coupling occurs in the order, the quasi-TM mode→the quasi-TEM mode→the quasi-TEM mode→the quasi-TM mode, from the coaxial connector 8*a* to the coaxial connector 8*b,* and thus the filter functions as a band-pass filter comprising four-step resonators.

Figure 8:
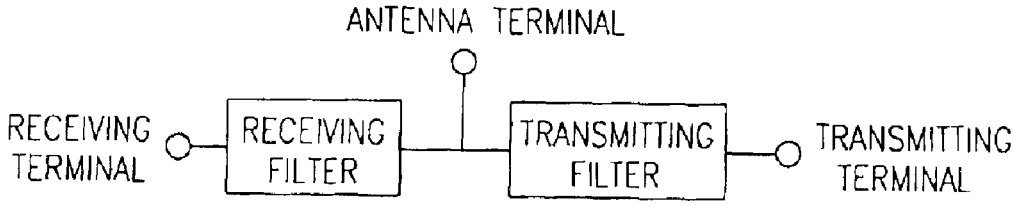
FIG. 8 is a drawing showing an example of the construction of a duplexer according to the present invention.

FIG. 8 shows an example of the construction of a duplexer. In FIG. 8, each of a transmitting filter and a receiving filter comprises the filter shown in FIG. 7. The transmitting filter transmits the frequency of a transmitting signal, and the receiving filter transmits the frequency of a received signal. The connection position between the output port of the transmitting filter and the input port of the receiving filter is set so that the electrical length from the connection point to the equivalent short-circuit surface of the final resonator of the transmitting filter is an odd multiple of the ¼ wavelength of the frequency of the received signal, and the electrical length from the connection position to the equivalent short-circuit surface of the first resonator of the receiving filter is an odd multiple of the ¼ wavelength of the frequency of the transmitting signal. This can securely branch the transmitting signal from the received signal.

Similarly, by providing a plurality of dielectric filters between a common port and an individual port, a diplexer or multiplexer can be formed.

Figure 9:
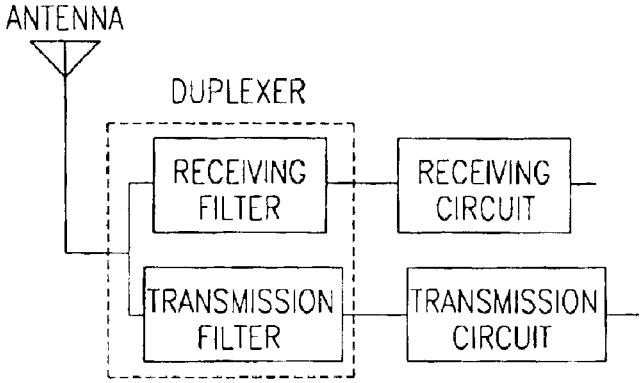
FIG. 9 is a block diagram showing the configuration of a communicaton apparatus according to the present invention.
Figure 10:
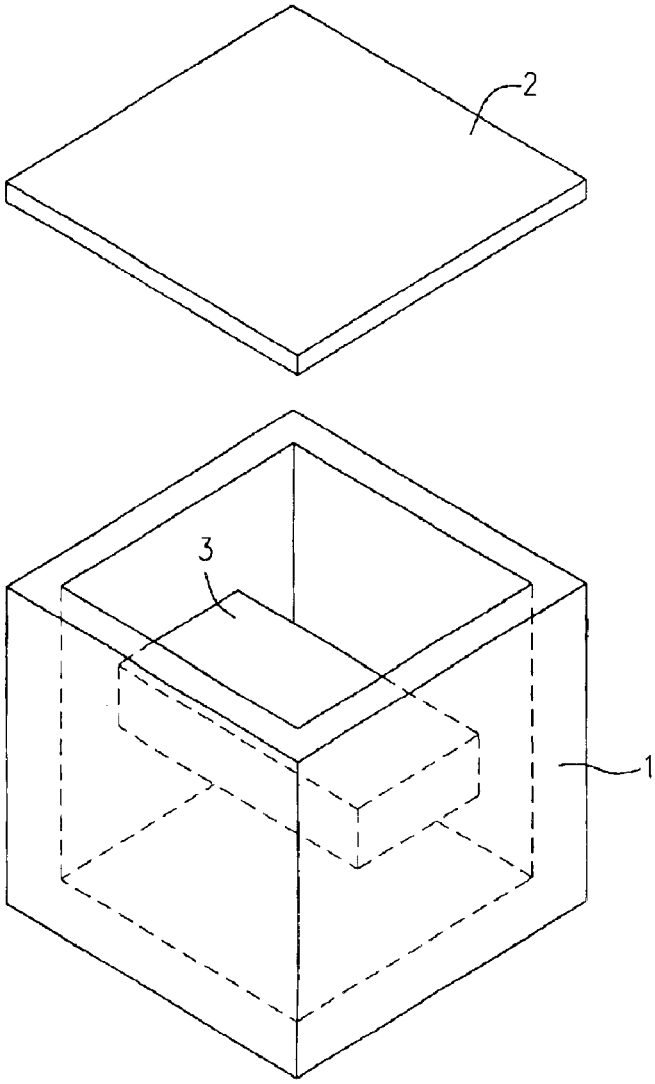
FIG. 10 is a perspective view showing the configuration of a conventional dielectric resonator.
Figure 11A:
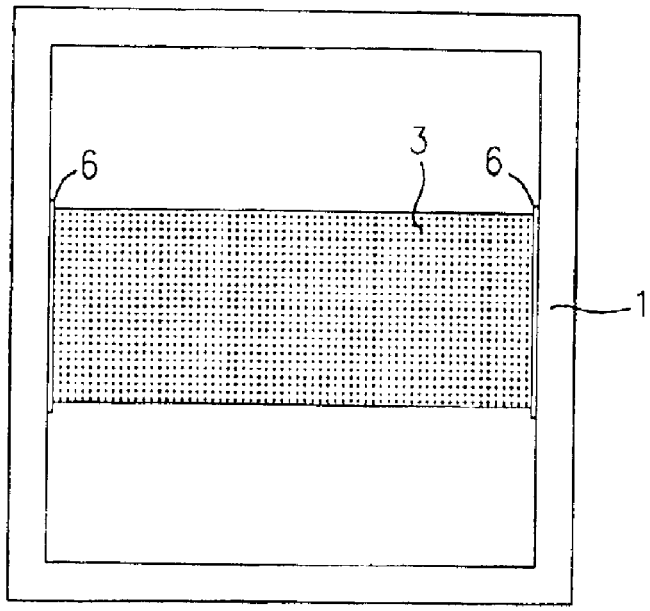
FIGS. 11A and 11B are respectively a top view and a sectional view of the dielectric resonator shown in FIG. 10.
Figure 11B:
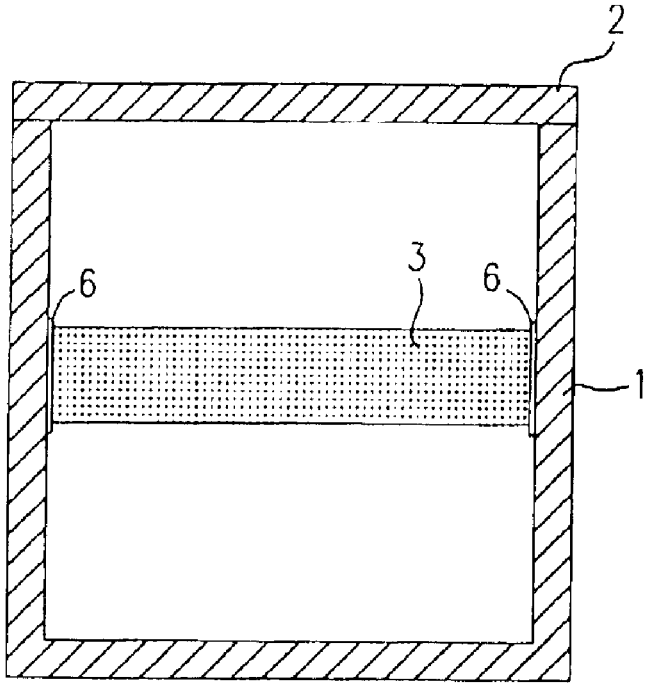

FIG. 9 is a block diagram showing the construction of a communication device using the duplexer. As shown in FIG. 9, a transmitting circuit and a receiving circuit are respectively connected to the input port of a transmitting filter and the output port of a receiving filter, and an antenna is connected to the input/output port of the duplexer to form a radio-frequency section of the communication device.

Furthermore, other circuit elements such as a diplexer, a multiplexer, a synthesizer, a divider, etc. are formed by using the dielectric resonator, and a small communication device can be obtained by using these circuit elements.

In the present invention, joint portions of earth plates each having a bent spring portion are respectively joined to two opposing side faces of a dielectric core preferably with a conductive binder, and the spring portions of the earth plates are joined to the inner surface of a cavity. Also, each of the earth plates has slits provided at positions in contact with the four corners of each of the two side faces of the dielectric core. Therefore, thermal stress due to a difference between the linear expansion coefficients of each of the two side faces of the dielectric core and the earth plate is not concentrated in the four corners of each of the two side faces of the dielectric core, thereby preventing peeling of the earth plates.

In the present invention, materials for both the dielectric core and the earth plates are preferably selected so that the difference between the linear expansion coefficients is within ±2 ppm/° C., and thus thermal stress produced in the joint surfaces can be decreased to prevent peeling of the earth plates.

In the present invention, each of the earth plates preferably has protrusions formed to engage with the edges of each end of the dielectric core, and thus the dielectric core can be easily positioned relative to the earth plates, thereby improving the precision of the dielectric core mounting position in a cavity.

In the present invention, the cavity has a bottom, an opening parallel to the bottom, and at least two parallel sides perpendicular to the bottom, and each of the earth plates has a substantially rectangular shape having sides parallel to the bottom and the opening of the cavity. Each of the earth plates preferably has a bent-up portion provided on the side parallel to the opening of the cavity to be positioned between the side of the cavity and each of the earth plates. Therefore, with the earth plates joined to the dielectric core mounted in the cavity, solder cream can be applied to the sides of the earth plates parallel to the opening of the cavity.

In the present invention, each of the earth plates preferably has a trapezoidal shape having two sides parallel to the bottom and the opening of the cavity, and other two sides inclined so that the distance between the two sides decreases from the opening to the bottom of the cavity, and concave portions are formed in the inner surface of the cavity so as to be butted on the bottom side and the two inclined sides of each of the earth plates. Therefore, in soldering the three sides of each of the trapezoidal earth plates to the sides of the cavity, solder cream can be previously applied to the concave portions of the sides of the cavity, improving productivity.

In the present invention, the space between each of the earth plates and the side of the cavity is preferably filled with a thermosetting resin, and the thermosetting resin is cured to fix the earth plates and the dielectric core to the inside of the cavity. Therefore, variations in electrical characteristics due to vibration of the dielectric core can be suppressed.

Furthermore, the elastic modulus of the thermosetting resin is preferably set to be $10^7$ Pa to $10^9$ Pa in the working temperature range of a dielectric resonator, and thus the position of the dielectric resonator less varies due to vibration or the like, and strong stress is not applied to the dielectric resonator to obtain high reliability and stable characteristics.

Furthermore, in the present invention, a communication device having stable characteristics and high reliability can be obtained by using a filter and a duplexer each having the above-described construction.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric resonator comprising:

a dielectric core having an electrode formed on each of two opposing side faces;

a conductive body surrounding the dielectric core; and two earth plates, each earth plate including a joint and a bent spring portion, wherein each joint is joined to a respective side face of the dielectric core with a conductive binder, and the spring portions are joined to an inner surface body with the conductive binder, and wherein each of the earth plates has slits provided at positions corresponding to corners of each of the opposing side faces of the dielectric core.

2. A filter comprising:

a dielectric resonator according claim 1; and a signal input/output means coupled with a resonance-mode electromagnetic field of the dielectric resonator for inputting and outputting a signal.

3. A communication device comprising a filter according to claim 2.

4. A duplexer comprising a dielectric resonator according to claim 1.

5. A dielectric resonator comprising:

a dielectric core having an electrode formed on each of two opposing side faces;

a conductive body surrounding the dielectric core; and two earth plates, each earth plate including a joint and a bent spring portion, wherein each joint is joined to a respective side face of the dielectric core with a conductive binder, and the spring portions are joined to an inner surface of the body with the conductive binder, and wherein materials for both the earth plates and the dielectric core are selected so that a difference between respective coefficients of linear expansion is within ±2 ppm/° C.

6. A dielectric resonator comprising:

a dielectric core having an electrode formed on each of two opposing side faces;

a conductive body surrounding the dielectic core; and two earth plates, each earth plate including a joint and a bent spring portion, wherein each joint is joined to a respective side face of the dielectric core with a conductive binder, and the spring portions are joined to an inner surface of the body with the conductive binder, and wherein each of the earth plates has protrusions that engage with respective edges of each side face of the dielectric core.

7. A dielectric resonator comprising:

a dielectric core having an electrode formed on each of two opposing side faces;

a conductive body surrounding the dielectric core; and two earth plates, each earth plate including a joint and a bent spring portion, wherein each joint is joined to a respective side face of the dielectric core with a conductive binder, and the spring portions are joined to an inner surface of the body with the conductive binder, and wherein the body has a bottom and at least two parallel sides extending from the bottom to form an opening parallel to the bottom, and wherein each of the earth plates has a substantially rectangular shape having a first side parallel to the bottom and a second side parallel to the opening of the body, and a bent-up portion provided on the second side parallel to the opening of the body so that solder can be applied between the side of the body and the earth plate.

8. A dielectric resonator comprising:

a dielectric core having an electrode formed on each of two opposing side faces;

a conductive body surrounding the dielectric core; and two earth plates, each earth plate including a joint and a bent spring portion, wherein each joint is joined to a respective side face of the dielectric core with a conductive binder, and the spring portions are joined to an inner surface of the body with the conductive binder, wherein each of the earth plates has a trapezoidal shape having respective sides parallel to a bottom and an opening of the body, and two sides inclined so that the distance between the two sides decreases from the opening of the body towards the bottom of the body, and wherein concave portions are formed in the inner surfaces of the body to which each of the earth plates are joined.

9. A dielectric resonator comprising:

a dielectric core having an electrode formed on each of two opposing side faces;

a conductive body surrounding the dielectric core; and two earth plates, each earth plate including a joint and a bent spring portion, wherein each joint is joined to a respective side face of the dielectric core with a conductive binder, and the spring portions are joined to an inner surface of the body with the conductive binder, wherein the earth plates are fixed to the inner surface of the body by curing a thermosetting resin in a space between the earth plates and the inner surface of the body.

10. The dielectric resonator according to claim 9, wherein an elastic modulus of the thermosetting resin is on the order of 107 Pa to 109 Pa in a working temperature range of the dielectric resonator.

* * * * *